US008007325B2

(12) United States Patent
Yotsutani

(10) Patent No.: US 8,007,325 B2
(45) Date of Patent: Aug. 30, 2011

(54) CABLE CONNECTING APPARATUS

(75) Inventor: Kenichi Yotsutani, Kanagawa (JP)

(73) Assignee: I-PEX Co., Ltd. (JP)

( * ) Notice: Subject to any disclaimer, the term of this patent is extended or adjusted under 35 U.S.C. 154(b) by 0 days.

(21) Appl. No.: 12/969,193

(22) Filed: Dec. 15, 2010

(65) Prior Publication Data

US 2011/0177721 A1 Jul. 21, 2011

(30) Foreign Application Priority Data

Jan. 21, 2010 (JP) ..... 2010-011075

(51) Int. Cl.
*H01R 24/00* (2011.01)

(52) U.S. Cl. ..... 439/660; 439/579

(58) Field of Classification Search ..... 439/660, 439/579, 497
See application file for complete search history.

(56) References Cited

U.S. PATENT DOCUMENTS 4,749,371 A * 6/1988 Hirai et al. ..... 439/497
6,454,606 B2 * 9/2002 Igarashi ..... 439/607.41
6,475,024 B1 * 11/2002 Narui ..... 439/495
7,074,075 B2 * 7/2006 Miyazawa ..... 439/499
7,374,451 B2 * 5/2008 Wei et al. ..... 439/495
7,377,812 B2 * 5/2008 Fukushima et al. ..... 439/607.41

FOREIGN PATENT DOCUMENTS

JP 2005-158677 A 6/2005
JP 2007-73426 A 3/2007

* cited by examiner

*Primary Examiner* — T C Patel
*Assistant Examiner* — Travis Chambers
(74) *Attorney, Agent, or Firm* — Studebaker & Brackett PC; Donald R. Studebaker

(57) ABSTRACT

A cable connecting apparatus comprises a plug type connector having a connectively engaging portion provided with a plurality of plug contacts which are arranged on each of first and second opposite surfaces of the connectively engaging portion to be connected with cables and a receptacle type connector having a housing on which an opening through which the connectively engaging portion of the plug type connector is inserted is formed at an end portion of the housing and a plurality of receptacle contacts arranged in the housing, wherein each of the receptacle contacts is provided with a pair of contacting points for coming into press-contact with the plug contact respectively on both sides of the first and second surfaces of the connectively engaging portion of the plug type connector and a distance from the end portion of the housing to one of the contacting points is different from a distance from the end portion of the housing to the other of the contacting points.

6 Claims, 9 Drawing Sheets

CABLE CONNECTING APPARATUS

BACKGROUND OF THE INVENTION

1. Field of the Invention

The present invention relates generally to a cable connecting apparatus, and more particularly to an improvement in a cable connecting apparatus which comprises a plug type connector with which a plurality of cables such as coaxial cables are coupled and a receptacle type connector which is provided with an opening through which a connectively engaging portion of the plug type connector is inserted in the receptacle type connector, and is used for connecting electrically the cables coupled with the plug type connector with an electrical device such as an electric circuit board to which the receptacle type connector is fixed to be electrically connected therewith.

2. Description of the Prior Art

When a plurality of cables such as coaxial cables for transmitting various kinds of electric signals, voltages and so on, each of which is relatively slender, are electrically connected to an electric circuit board, on which various electrical parts are mounted, in a such manner as to be bundled to form a thin flat cable assembly, there has been proposed to use often a cable connecting apparatus which is operative to mediate between the cables and the electric circuit board with which the cables are to be electrically connected. The cable connecting apparatus thus used comprises, for example, a plug type connector having a connectively engaging portion with which the cables are coupled and a receptacle type connector provided with an opening through which the connectively engaging portion of the plug type connector is inserted in the receptacle type connector.

In the cable connecting apparatus used for connecting electrically the cables to the electric circuit board in such a manner as mentioned above, a plurality of plug contacts, with which the cables are connected respectively, are provided to be arranged on the connectively engaging portion of the plug type connector and a plurality of receptacle contacts, a portion of each of which is connected with a circuit portion provided on the electric circuit board, are provided to be arranged at the inside of the opening of the receptacle type connector. When the connectively engaging portion of the plug type connector is inserted through the opening in the receptacle type connector, the receptacle contacts come into press-contact respectively with the plug contacts to be electrically connected with the same so that the cables are electrically connected through the plug type and receptacle type connectors with the circuit portion on the electric circuit board.

In regard to the cable connecting apparatus wherein the connectively engaging portion of the plug type connector is inserted in the receptacle type connector through the opening provided thereon as mentioned above, it has been desired to be miniaturized in thickness as a whole so as to connect the cables each of which is still more slenderized with the electric circuit board which is still more miniaturized in size and reduced in weight. Accordingly, it has been required for the plug type connector to have an improved connectively engaging portion reduced in thickness as much as possible and it has been also required for the receptacle type connector to have a plurality of improved receptacle contacts which are able to come surely into press-contact respectively with the plug contacts provided on the connectively engaging portion of the plug type connector reduced in thickness and to keep the press-contact with the plug contacts stable.

Under such a situation, there has been previously proposed a cable connecting apparatus comprising a plug type connector and a receptacle type connector to be used for connecting electrically a plurality of cables with an electric circuit board, wherein each of plug contacts provided on a connectively engaging portion of the plug type connector to be connected with the cable is formed to have a pair of contacting surfaces opposite to each other and each of receptacle contacts provided on the receptacle type connector is formed to have a pair of contacting portions operative to come into press-contact respectively with the contacting surfaces of the plug contact so as to cause the receptacle contact to be connected electrically with the plug contact, as disclosed in, for example, the Japanese patent application published before examination under publication number 2007-73426 (hereinafter, referred to as published patent document 1). Further, there has been also previously proposed another cable connecting apparatus comprising a plug type connector and a receptacle type connector to be used for connecting electrically a plurality of cables with an electric circuit board, wherein each of plug contacts provided on a connectively engaging portion of the plug type connector is formed to have a plate member extending along a core wire of the cable which is connected with the plug contact and having a pair of opposite surfaces, on one of which the core wire of the cable is placed, and each of receptacle contacts provided on the receptacle type connector is formed to have a contacting point operative to come into contact with the other of the opposite surfaces of the plate member of the plug contact so as to cause the receptacle contact to be connected electrically with the plug contact, as disclosed in, for example, the Japanese patent application published before examination under publication number 2005-158677 (hereinafter, referred to as published patent document 2).

In the previously proposed cable connecting apparatus disclosed in the published patent document 1, each of a plurality of plug contacts (male terminals 50) provided to be arranged on a connectively engaging portion of a plug type connector (a plug 2) is constituted to be a three-layer structure in which a conductive plate member is folded to form a pair of plate portions (the upper and lower plate portion 52 and 53) facing each other with a plastic plate member which is a part of a housing (20) between or an incorporated structure formed by causing a relatively thick conductive plate member to be subjected to processing for punching so as to have a pair of contacting surfaces (an outer surface of an upper plate portion 52 and an outer surface of a lower plate portion 53) opposite to each other. Further, each of a plurality of receptacle contacts (female terminals 80) provided to be arranged on a receptacle type connector (a receptacle 6) is provided with a fork-shaped portion having a pair of contacting projections (contacting points 81 and 82) facing each other with the contacting surfaces of the plug contact constituted to be the three-layer structure or the incorporated structure between.

The contacting projections of each of the receptacle contacts are operative to come into contact respectively with the contacting surfaces of one of the plug contacts from the outside thereof so that the plug contacts are electrically connected respectively with the receptacle contacts.

In another previously proposed cable connecting apparatus disclosed in the published patent document 2, each of a plurality of plug contacts (terminals 12) provided to be arranged on a connectively engaging portion forming a part of a housing (11) of a plug type connector (a cable connector 1) is provided with a plate member extending along a core wire (22*a*) of a cable (22) set to be soldered to the plate member so as to form a contacting portion (20) and an end portion of the plate member is folded back to form a projecting end portion (folded portion 18). Further, each of a plurality of receptacle contacts (terminals 33) provided to be arranged on a receptacle type connector (a mate connector 31) is provided with a contacting point (36) operative to come into contact with a surface of the plate member of the plug contact, which is opposite to another surface of the plate member to which the core wire of the cable is soldered.

With the contacting point of each of the receptacle contact put in contact with the surface of the plate member of each of the plug contact, the receptacle contact is electrically connected with the plug contact.

In the cable connecting apparatus proposed previously as disclosed in the published patent document 1, which comprises the plug type connector and the receptacle type connector to be used for connecting electrically the cables with the electric circuit board and in which each of the plug contacts provided on the connectively engaging portion of the plug type connector is constituted to be the three-layer structure or the incorporated structure to form the contacting surfaces opposite to each other and each of the receptacle contacts provided on the receptacle type connector is provided with the fork-shaped portion having the contacting projections facing each other with the contacting surfaces of the plug contact constituted to be the three-layer structure or the incorporated structure between, the receptacle contact is operative to cause the contacting projections thereof to come into contact respectively with the contacting surfaces of the same portion of the plug contact in two directions opposite to each other when the contacting projections of each of the receptacle contacts comes into contact respectively with the contacting surfaces of one of the plug contacts from the outside thereof.

Therefore, in each of the plug contacts, pressure by the contacting projections of the receptacle contact concentrates to a particular portion of the plug contact and such particular portions of the plug contacts are arranged in a line extending in a direction along which the plug contacts are arranged. As a result, it is feared that, under a condition where the connecting projections of each of the receptacle contacts are put in press-contact with one of the plug contacts, the connectively engaging portion of the plug type connector becomes unstable in its posture and brings about undesirable changes in its posture and position.

Besides, in the case where each of the plug contacts is constituted to be the three-layer structure, it is difficult to reduce enough the thickness of each of the plug contacts and therefore also difficult to reduce effectively the thickness of the connectively engaging portion of the plug type connector, and in the case where each of the plug contacts is constituted to be the incorporated structure, it is required to cause the relatively thick conductive plate member to be subjected to processing for punching, which is improved to be extremely highly precise, and in addition it is feared that the plug contacts are not surely stuck on insulating material such as plastics forming the connectively engaging portion of the plug type connector.

Further, in the cable connecting apparatus proposed previously as disclosed in the publication patent document 2, which comprises the plug type connector and the receptacle type connector to be used for connecting electrically the cables to the electric circuit board and in which each of the plug contacts is provided with the plate member to which the core wire of the cable are soldered for forming the contacting portion and the end portion of the plate member is folded back to form the projecting end portion and each of the receptacle contacts is provided with the contacting point operative to come into contact with the surface of the plate member of the plug contact, which is opposite to another surface of the plate member to which the core wire of the cable is soldered, since the plug contacts are pressed into the housing of the plug type connector and stuck on insulating material such as plastics forming the housing at a relatively small area, it is also feared that the plug contacts are not surely stuck on the insulating material forming the connectively engaging portion as the part of the housing of the plug type connector.

OBJECTS AND SUMMARY OF THE INVENTION

Accordingly, it is an object of the present invention to provide a cable connecting apparatus comprising a plug type connector with which a plurality of cables are coupled and a receptacle type connector which is provided with an opening through which a connectively engaging portion of the plug type connector is inserted in the receptacle type connector to be used for connecting electrically the cables coupled with to the plug type connector with an electrical device such as an electric circuit board, which avoids the aforementioned problems and disadvantages encountered with the prior art.

Another object of the present invention is to provide a cable connecting apparatus comprising a plug type connector with which a plurality of cables are coupled and a receptacle type connector which is provided with an opening through which a connectively engaging portion of the plug type connector is inserted in the receptacle type connector to be used for connecting electrically the cables coupled with the plug type connector with an electrical device such as an electric circuit board, in which a plurality of receptacle contacts provided on the receptacle type connector can be surely connected respectively with a plurality of plug contacts provided on the connectively engaging portion of the plug type connector even if the connectively engaging portion is improved to reduce its thickness.

A further object of the present invention is to provide a cable connecting apparatus comprising a plug type connector with which a plurality of cables are coupled and a receptacle type connector which is provided with an opening through which a connectively engaging portion of the plug type connector is inserted in the receptacle type connector to be used for connecting electrically the cables coupled with the plug type connector with an electrical device such as an electric circuit board, in which the connectively engaging portion of the plug type connector can be held stably without becoming unstable in its posture and bringing about undesirable changes in its posture and position under a condition where the receptacle contacts are put in press-contact respectively with the plug contacts.

A still further object of the present invention is to provide a cable connecting apparatus comprising a plug type connector with which a plurality of cables are coupled and a receptacle type connector which is provided with an opening through which a connectively engaging portion of the plug type connector is inserted in the receptacle type connector to be used for connecting electrically the cables coupled with the plug type connector with an electrical device such as an electric circuit board, in which the connectively engaging portion of the plug type connector can be reduced effectively in its thickness and provided with the plug contacts stuck firmly on insulating material forming the connectively engaging portion of the plug type connector.

According to the present invention, as claimed in accompanying claims, there is provided a cable connecting apparatus, which comprises a plug type connector having a connectively engaging portion on which a plurality of plug contacts are arranged to be connected with a plurality of cables and a receptacle type connector having a housing on which an opening through which the connectively engaging portion of the plug type connector is inserted in the housing is provided to be formed at an end portion of the housing and a plurality of receptacle contacts arranged in the housing for coming into press-contact with the plug contacts arranged on the connectively engaging portion of the plug type connector inserted in the housing through the opening provided thereon. The receptacle contacts include a plurality of first contacts and a plurality of second contacts. Each of the first contacts has first and second contacting portions operative to be opposite to each other with the connectively engaging portion of the plug type connector inserted in the housing through the opening provided thereon between. The first and second contacting portions have respectively first and second contacting points and a distance from the end portion of the housing at which the opening is formed to the first contacting point is shorter than a distance from the end portion of the housing at which the opening is formed to the second contacting point. The first contacting point is operative to come into press-contact with the plug contact on the side of a first surface of the connectively engaging portion of the plug type connector and the second contacting point is operative to come into press-contact with the plug contact on the side of a second surface opposite to the first surface of the connectively engaging portion of the plug type connector. Further, each of the second contacts has third and fourth contacting portions operative to be opposite to each other with the connectively engaging portion of the plug type connector inserted in the housing through the opening provided thereon between. The third and fourth contacting portions have third and fourth contacting points, respectively, and a distance from the end portion of the housing at which the opening is formed to the third contacting point is longer than a distance from the end portion of the housing at which the opening is formed to the fourth contacting point. The third contacting point is operative to come into press-contact with the plug contact on the side of the first surface of the connectively engaging portion of the plug type connector and the fourth contacting point is operative to come into press-contact with the plug contact on the side of the second surface opposite to the first surface of the connectively engaging portion of the plug type connector.

In the cable connecting apparatus thus constituted in accordance with the present invention, when the connectively engaging portion of the plug type connector is inserted in the housing of the receptacle type connector through the opening provided thereon, the receptacle contacts arranged in the housing of the receptacle type connector come into press-contact respectively with the plug contacts arranged on the connectively engaging portion of the plug type connector. In such a condition, the first and second contacting points provided respectively on the first and second connecting portions of each of the first contacts contained in the receptacle contacts are put in press-contact with a corresponding one of the plug contacts and the third and fourth contacting points provided respectively on the third and fourth connecting portions of each of the second contacts contained in the receptacle contacts are also put in press-contact with a corresponding one of the plug contacts. The first and second connecting points are placed respectively at such positions that the distance from the end portion of the housing at which the opening is formed to the first contacting point is shorter than the distance from the end portion of the housing at which the opening is formed to the second contacting point so that the first contacting point is put in press-contact with the plug contact on the side of the first surface of the connectively engaging portion of the plug type connector and the second contacting point is put in press-contact with the plug contact on the side of the second surface opposite to the first surface of the connectively engaging portion of the plug type connector. Further, the third and fourth connecting points are placed respectively at such positions that the distance from the end portion of the housing at which the opening is formed to the third contacting point is longer than the distance from the end portion of the housing at which the opening is formed to the fourth contacting point so that the third contacting point is put in press-contact with the plug contact on the side of the first surface of the connectively engaging portion of the plug type connector and the fourth contacting point is put in press-contact with the plug contact on the side of the second surface opposite to the first surface of the connectively engaging portion of the plug type connector.

That is, the first and second contacting points provided respectively on the first and second connecting portions of each of the first contacts included in the receptacle contacts are put in press-contact with the plug contact respectively on the sides of the first and second surfaces of the connectively engaging portion of the plug type connector at respective positions remote from each other in a direction along which the connectively engaging portion of the plug type connector is inserted in the housing of the receptacle type connector through the opening provided thereon, and the third and fourth contacting points provided respectively on the third and fourth connecting portions of each of the second contacts included in the receptacle contacts are also put in press-contact with the plug contact respectively on the sides of the first and second surfaces of the connectively engaging portion of the plug type connector at respective positions remote from each other in the direction along which the connectively engaging portion of the plug type connector is inserted in the housing of the receptacle type connector through the opening provided thereon. Consequently, the first and second contacts included in the receptacle contacts come into press-contact with respective portions apart from each other of one of the plug contacts from respective directions opposite to each other.

Especially, in a first example of cable connecting apparatus according to the present invention, such as claimed in claim 3, the first and second contacts included in the receptacle contacts are arranged one after the other in the direction along which the receptacle contacts are arranged.

Further, in a second example of cable connecting apparatus according to the present invention, such as claimed in claim 4, the plug contacts include a plurality of third contacts and a plurality of fourth contacts, which are arranged one after the other in the direction along which the plug contacts are arranged. Each of the third contacts has a cable connecting portion with which the cable is connected, a first contact-receiving portion with which one of the first and second contacting points of the first contact comes into press-contact and a second contact-receiving portion folded back from the first contact-receiving portion, with which the other of the first and second contacting points of the first contact comes into press-contact. Each of the fourth contacts has a cable connecting portion with which the cable is connected, a third contact-receiving portion with which one of the third and fourth contacting points of the second contact comes into press-contact and a fourth contact-receiving portion folded back from the third contact-receiving portion, with which the other of the third and fourth contacting points of the second contact comes into press-contact. A top end portion of the second contact-receiving portion of each of the third contacts and a top end portion of the fourth contact-receiving portion of each of the fourth contacts are provided to be partially surrounded by the insulating material forming the connectively engaging portion of the plug type connector.

In the cable connecting apparatus according to the present invention, as described above, the first and second contacts included in the receptacle contacts come into press-contact with the respective portions apart from each other of one of the plug contacts provided on the connectively engaging portion of the plug type connector from the respective directions opposite to each other. Accordingly, with the cable connecting apparatus according to the present invention, it can be avoided that pressure by the first and second contacts each put in press-contact with the plug contact provided on the connectively engaging portion of the plug type connector concentrates to a particular portion of the plug contact. Therefore, the receptacle contacts can be surely connected respectively with the plug contacts provided on the connectively engaging portion of the plug type connector even if the connectively engaging portion is improved to reduce its thickness, and the connectively engaging portion of the plug type connector can be held stably without becoming unstable in its posture and bringing about undesirable changes in its posture and position when the receptacle contacts are put in press-contact respectively with the plug contacts.

Especially, with the first example of cable connecting apparatus according to the present invention, such as claimed in claim 3, since the first and second contacts included in the receptacle contacts are arranged one after the other in the direction along which the receptacle contacts are arranged, a condition wherein the receptacle contacts are surely connected respectively with the plug contacts provided on the connectively engaging portion of the plug type connector and the connectively engaging portion of the plug type connector is held stably without becoming unstable in its posture and bringing about undesirable changes in its posture and position when the receptacle contacts are put in press-contact respectively with the plug contacts, can be obtained still more effectively, Further, in the second example of cable connecting apparatus according to the present invention, such as claimed in claim 4, as described above, the plug contacts include the third contacts and the fourth contacts, each of the third contacts has the first contact-receiving portion with which one of the first and second contacting points of the first contact comes into press-contact and the second contact-receiving portion folded back from the first contact-receiving portion, with which the other of the first and second contacting points of the first contact comes into press-contact, each of the fourth contacts has the third contact-receiving portion with which one of the third and fourth contacting points of the second contact comes into press-contact and the fourth contact-receiving portion folded back from the third contact-receiving portion, with which the other of the third and fourth contacting points of the second contact comes into press-contact, and the top end portion of the second contact-receiving portion of each of the third contacts and the top end portion of the fourth contact-receiving portion of each of the fourth contacts are provided to be partially surrounded by the insulating material forming the connectively engaging portion of the plug type connector. Accordingly, with the second example of cable connecting apparatus according to the present invention, the connectively engaging portion of the plug type connector can be reduced effectively in its thickness and provided with the plug contacts stuck firmly on the insulating material forming the connectively engaging portion of the plug type connector.

The above, and other objects, features and advantages of the present invention will become apparent from the following detailed description taken in conjunction with the accompanying drawings.

DESCRIPTION OF THE PREFERRED EMBODIMENTS

An embodiment of cable connecting apparatus according to the present invention will be explained with reference to FIGS. 1 to 13.

Figure 1:
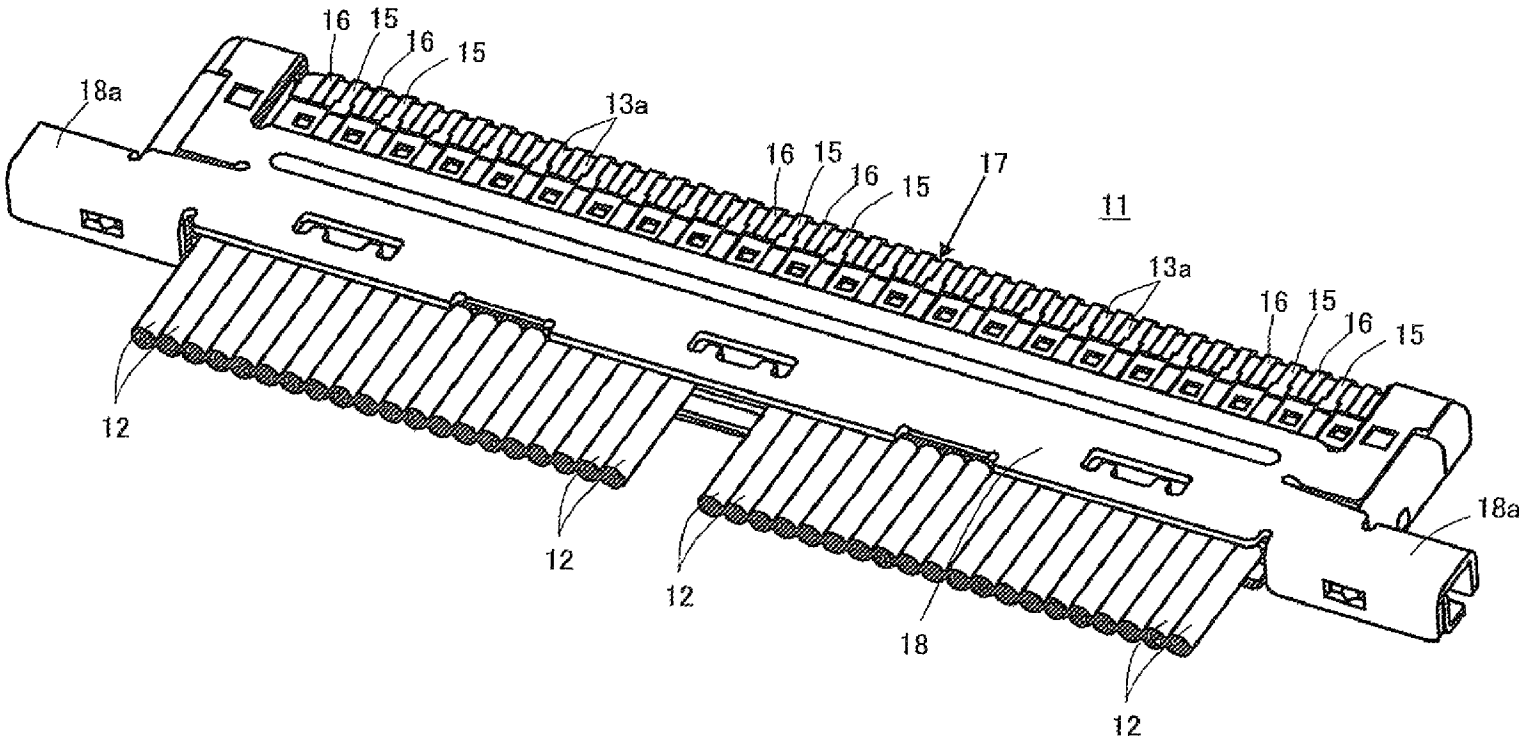
FIG. 1 is a schematic top perspective view showing a plug type connector constituting an embodiment of cable connecting apparatus according to the present invention.
Figure 2:
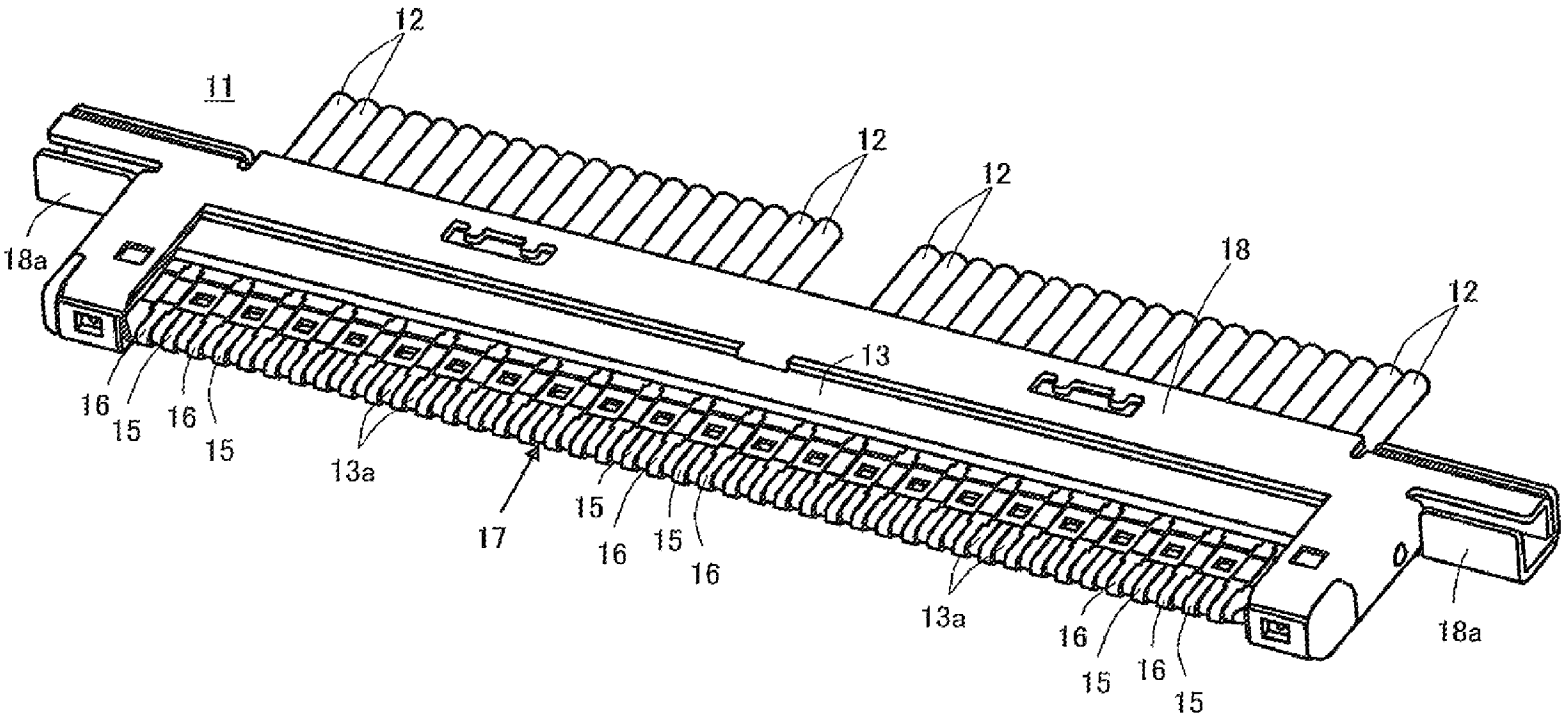
FIG. 2 is a schematic bottom perspective view showing the plug type connector constituting the embodiment of cable connecting apparatus according to the present invention, together with a plurality of coaxial cables coupled with therewith.
Figure 3:
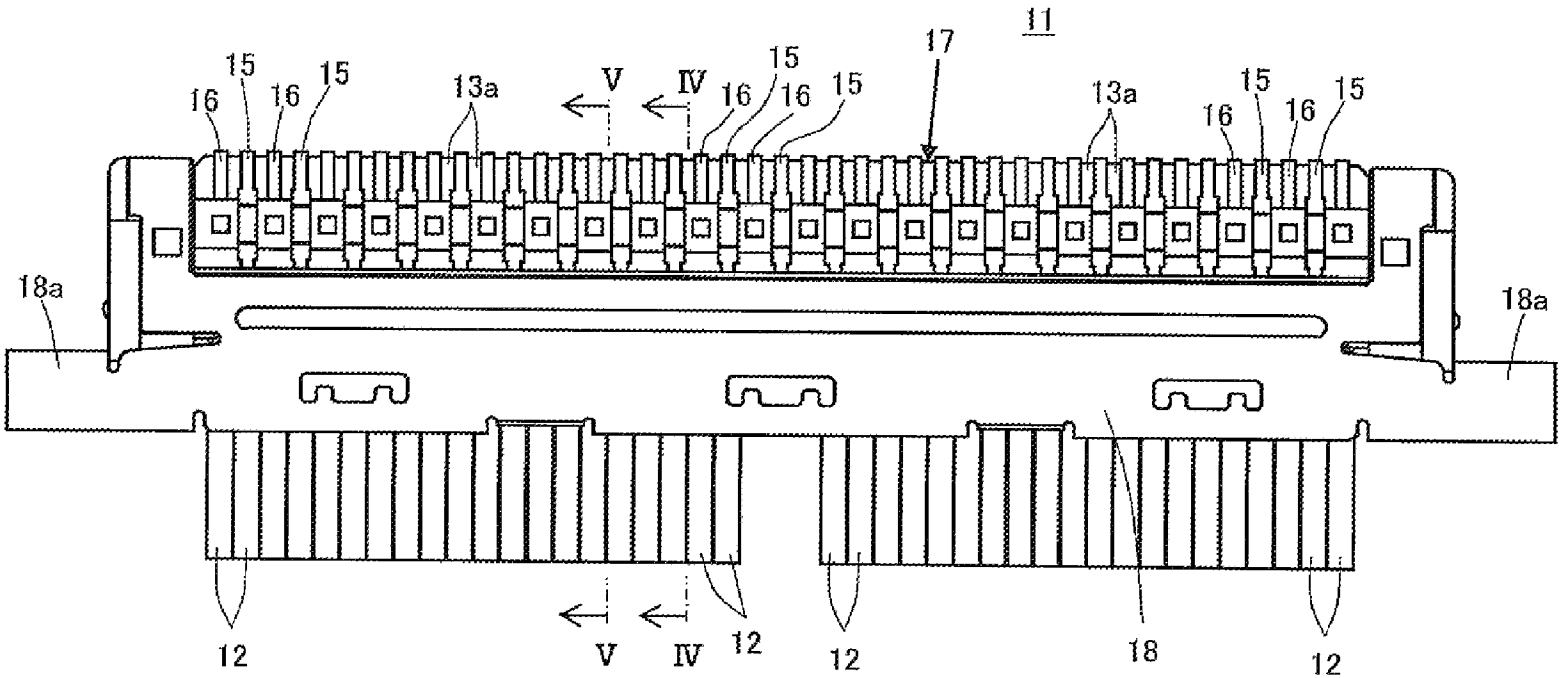
FIG. 3 is a schematic plane view showing the plug type connector constituting the embodiment of cable connecting apparatus according to the present invention, together with a plurality of coaxial cables coupled therewith.

In FIGS. 1, 2 and 3, a plug type connector 11 constituting the embodiment of cable connecting apparatus according to the present invention and a plurality of coaxial cables 12 coupled with the plug type connector 11 are shown. For the sake of convenience, hereinafter, a side of the plug type connector 11 shown in a plane view of FIG. 3 is referred to as an upper side of the plug type connector 11 and a side opposite to the upper side of the plug type connector 11 is refereed to a lower side of the plug type connector 11.

The plug type connector 11 comprises a housing 13 which is made of insulating material such as plastics. On the housing 13, a plurality of contacts 15 each made of conductive material and a plurality of contacts 16 each made of conductive material are arranged one after the other in a longitudinal direction of the housing 13 (a longitudinal direction of the plug type connector 11 (left and right directions)). The contacts 15 and the contacts 16 constitute a plurality of plug contacts in the aggregate. That is, the plug contacts provided to be arranged on the housing 13 include the contacts 15 and the contacts 16 arranged one after the other. The coaxial cables 12 are connected respectively with the plug contacts including the contacts 15 and the contacts 16.

A board-shaped portion 13*a* of the housing 13 on which the plug contacts including the contacts 15 and the contacts 16 are arranged forms a connectively engaging portion 17 elongating in the longitudinal direction of the housing 13. The connectively engaging portion 17 of the plug type connector 11 is caused to be inserted in a housing of a receptacle type connector described later, which constitutes the embodiment of cable connecting apparatus according to the present invention together with the plug type connector 11, through an opening provided on the housing of the receptacle type connector, so that the plug type connector 11 and the receptacle type connector are coupled with each other.

A portion of each of the plug contacts with which the coaxial cable 12 is connected is concealed with a plug cover member 18 made of conductive material. The plug cover member 18 is provided with a pair of projections 18*a* at both end portions thereof in its longitudinal direction (the longitudinal direction of the plug type connector 11). The projections 18*a* are used for holding the plug type connector 11 when the plug type connector is pulled out of the receptacle type connector.

Figure 4:
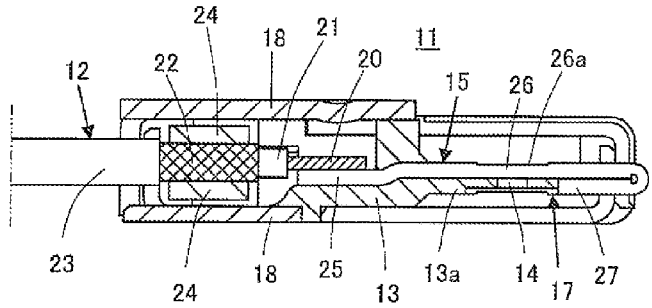
FIG. 4 is a schematic cross sectional view taken along line IV-IV on FIG. 3.

As shown in FIG. 4 representing a cross section taken along line IV-IV on FIG. 3, each of the coaxial cables 12 coupled with the plug type connector 11 has a core conductor (signal conductor) 20, an inner insulating layer 21 surrounding the core conductor 20, an outer conductor (ground conductor) 22 surrounding the inner insulating layer 21 and an insulating cover 23 surrounding the outer conductor 22. Each of the contacts 15 provided on the connectively engaging portion 17 formed with the board-shaped portion 13*a* of the housing 13 has a cable connecting portion 25 with which the core conductor 20 of the coaxial cable 12 is connected, a contact-receiving portion 26 extending from the cable connecting portion 25 to be attached to the board-shaped portion 13*a* of the housing 13 on the upper side of the plug type connector 11, and a contact-receiving portion 27 folded back from the contact-receiving portion 26 to stick to the contact-receiving portion 26 on the lower side of the plug type connector 11.

The contact-receiving portion 26 of the contact 15 is provided with a recess 26*a* with which a receptacle contact of the receptacle type connector comes into press-contact. A portion of the board-shaped portion 13*a* of the housing 13 on which the contact-receiving portion 26 of the contact 15 is placed is provided with a hole 14 at a position corresponding to the recess 26*a*. An insert pin for positioning the contact 15 is inserted through the hole 14 when the contacts 15 are fixed to the housing 13 by means on the insert method. With the hole 14 provided at the position corresponding to the recess 26*a* provided on the contact-receiving portion 26, each of the contacts 15 is precisely positioned on the board-shaped portion 13*a* of the housing 13.

Figure 5:
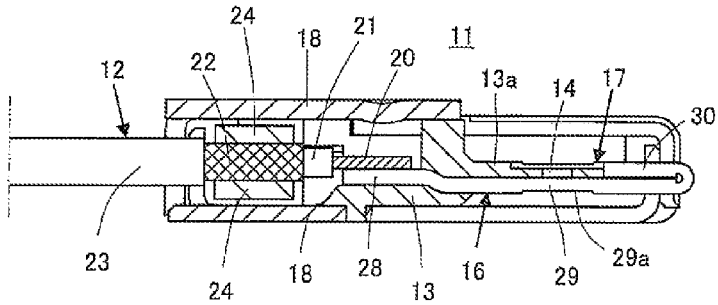
FIG. 5 is a schematic cross sectional view taken along line V-V on FIG. 3.

Further, as shown in FIG. 5 representing a cross section taken along line V-V on FIG. 3, each of the contacts 16 provided on the connectively engaging portion 17 formed with the board-shaped portion 13*a* of the housing 13 has a cable connecting portion 28 with which the core conductor 20 of the coaxial cable 12 is connected, a contact-receiving portion 29 extending from the cable connecting portion 28 to be attached to the board-shaped portion 13*a* of the housing 13 on the lower side of the plug type connector 11, and a contact-receiving portion 30 folded back from the contact-receiving portion 29 to stick to the contact-receiving portion 29 on the upper side of the plug type connector 11.

The contact-receiving portion 29 of the contact 16 is provided with a recess 29*a* with which the receptacle contact of the receptacle type connector comes into press-contact. A portion of the board-shaped portion 13*a* of the housing 13 on which the contact-receiving portion 29 of the contact 16 is placed is provided also with a hole 14 at a position corresponding to the recess 29*a*. An insert pin for positioning the contact 16 is inserted through the hole 14 when the contacts 16 are fixed to the housing 13 by means on the insert method. With the hole 14 provided at the position corresponding to the recess 29*a* provided on the contact-receiving portion 29, each of the contacts 16 is precisely positioned on the board-shaped portion 13*a* of the housing 13.

Incidentally, the outer conductors 22 of the coaxial cables 12 each having the core conductor 20 connected with the cable connecting portion 25 of the contact 15 or the cable connecting portion 28 of the contact 16 are connected through a couple of ground bars 24 with the plug cover member 18.

The connectively engaging portion 17 constituted as described above has upper and lower surfaces opposite to each other so that the contact-receiving portion 26 of each of the contacts 15 and the contact-receiving portion 30 of each of the contacts 16 are provided on the upper surface of the connectively engaging portion 17 and the contact-receiving portion 27 of each of the contacts 15 and the contact-receiving portion 29 of each of the contacts 16 are provided on the lower surface of the connectively engaging portion 17.

In the connectively engaging portion 17 on which the contacts 15 and the contacts 16 are arranged one after the other, since each of the contacts 15 is folded back from the upper surface of the connectively engaging portion 17 to the lower surface of the connectively engaging portion 17 and each of the contacts 16 is folded back from the lower surface of the connectively engaging portion 17 to the upper surface of the connectively engaging portion 17, upper and lower surfaces of the insulating material forming the board-shaped portion 13*a* of the housing 13 are provided to be well-balanced both on the side of the upper surface of the connectively engaging portion 17 and on the side of the lower surface of the connectively engaging portion 17. This results in that the connectively engaging portion 17 has been formed appropriately so as to able to avoid deformations brought about after its formation.

Figure 8:
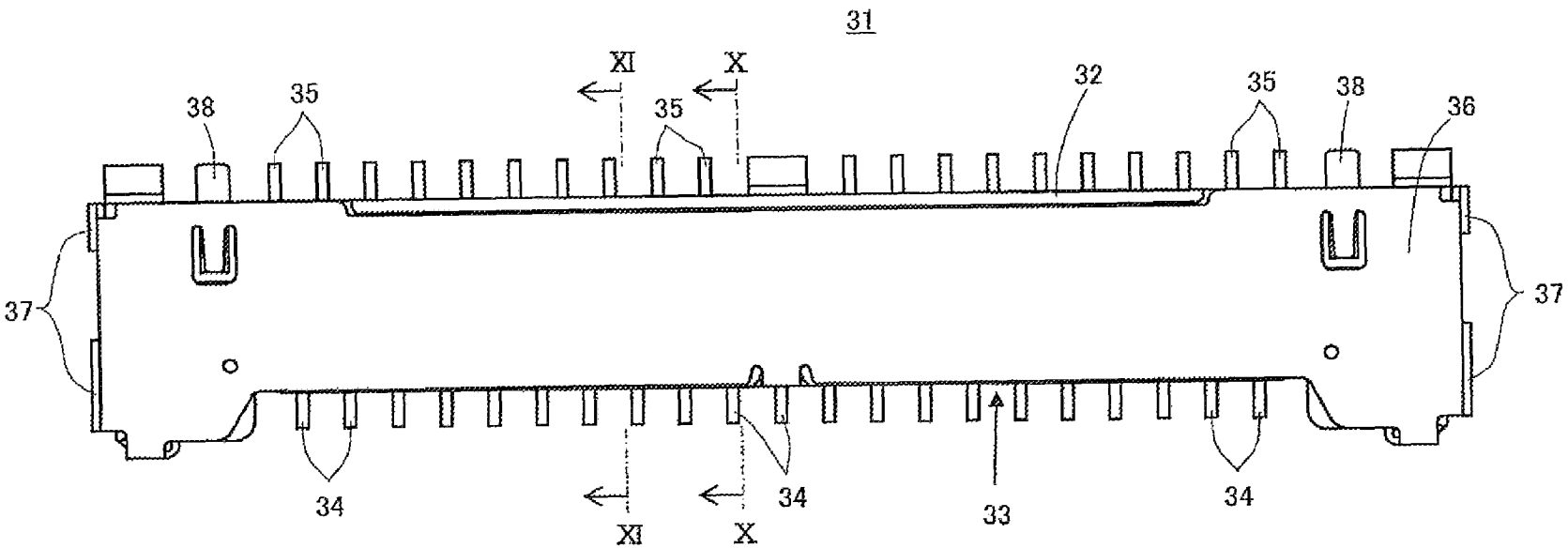
FIG. 8 is a schematic plane view showing the receptacle type connector constituting the embodiment of cable connecting apparatus according to the present invention.
Figure 9:
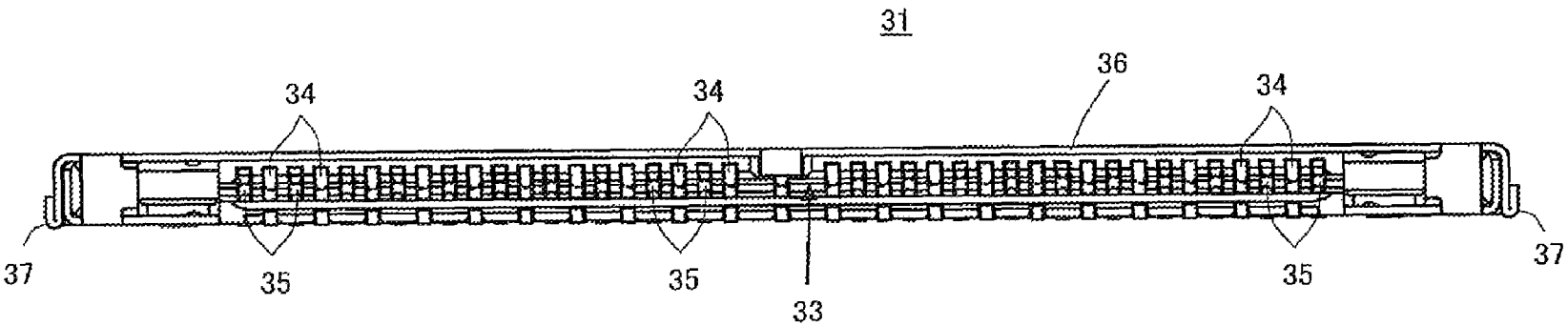
FIG. 9 is a schematic front view showing the receptacle type connector constituting the embodiment of cable connecting apparatus according to the present invention.

In FIGS. 6, 7, 8 and 9, a receptacle type connector 31 constituting the embodiment of cable connecting apparatus according to the present invention, together with the plug type connector 11, is shown. Especially, FIG. 9 shows a front end of the receptacle type connector 31. For the sake of convenience, hereinafter, an end of the receptacle type connector 31 opposite to the front end shown in FIG. 9 is referred to as a rear end of the receptacle type connector 31 and an upper side, a lower side, a left side and a right side of the receptacle type connector 31 are defined with regard to the front end of the receptacle type connector 31 shown in FIG. 9.

Referring to FIGS. 6 to 9, the receptacle type connector 31 comprises a housing 32 which is made of insulating material such as plastics. The housing 32 is provided at its front end portion an opening 33 through which the connectively engaging portion 17 of the plug type connector 11 is inserted in the housing 32 when the plug type connector 11 is coupled with the receptacle type connector 31 and an accommodating space for the connectively engaging portion 17 of the plug type connector 11 is provided in the housing 32 to extend from the opening 33. The housing 32 is mounted on, for example, an electric circuit board not shown in the drawings so that the receptacle type connector 31 is fixed in its entirety to the electric circuit board.

In the housing 32, a plurality of contacts 34 each made of conductive material and a plurality of contacts 35 each made of conductive material are arranged one after the other in a longitudinal direction of the housing 32 (a longitudinal direction of the receptacle type connector 31 (the left and right directions)). The contacts 34 and the contacts 35 constitute a plurality of receptacle contacts in the aggregate. That is, the receptacle contacts provided to be arranged in the housing 32 include the contacts 34 and the contacts 35 arranged one after the other.

The receptacle contacts including the contacts 34 and the contacts 35 are operative to come into press-contact respectively with the plug contacts provided on the connectively engaging portion 17 of the plug type connector 11 when the connectively engaging portion 17 of the plug type connector 11 is inserted in the housing 32 through the opening 33 provided thereon. On that occasion, the contacts 34 included in the receptacle contacts come into press-contact respectively with the contacts 15 included in the plug contacts and the contacts 35 included in the receptacle contacts come into press-contact respectively with the contacts 16 included in the plug contacts. Thereby, the plug contacts provided on the connectively engaging portion 17 of the plug type connector 11 are connected through the receptacle contacts of the receptacle type connector 31 with circuit terminals provided on the electric circuit board to which the receptacle type connector 31 is fixed.

The receptacle type connector 31 comprises also a conductive shell 36 mounted on the housing 32 for covering a major part of the housing 32 except the front end portion of the housing 32 at which the opening 33 is formed and a rear end portion, a small part of a left side end portion, a small part of a right side end portion and a part of a lower end portion of the housing 32. That is, the housing 32 is covered partially with the conductive shell 36.

The conductive shell 36 is formed by means of processing a metal thin plate and grounded to be operative, for example, to contribute to adjustment on characteristic impedance of each of the receptacle contacts provided in the housing 32 and to shield the receptacle contacts provided in the housing 32 from electromagnetic wave noises coming from the outside.

The conductive shell 36 is provided with a plurality of board connecting portions 37 at both end portions thereof in its longitudinal direction. Each of the board connecting portions 37 is connected with the electric circuit board to be fixed to the same by means of, for example, soldering when the receptacle type connector 31 is fixed in its entirety to the electric circuit board. The conductive shell 36 is also provided with a plurality of ground connecting portions 38, each of which is connected electrically with a grounded circuit portion provided on the electric circuit board when the receptacle type connector 31 is fixed in its entirety to the electric circuit board.

Figure 10:
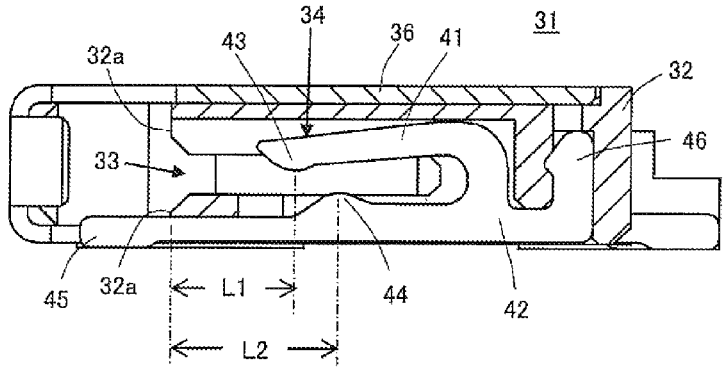
FIG. 10 is a schematic cross sectional view taken along line X-X on FIG. 8.
Figure 6:
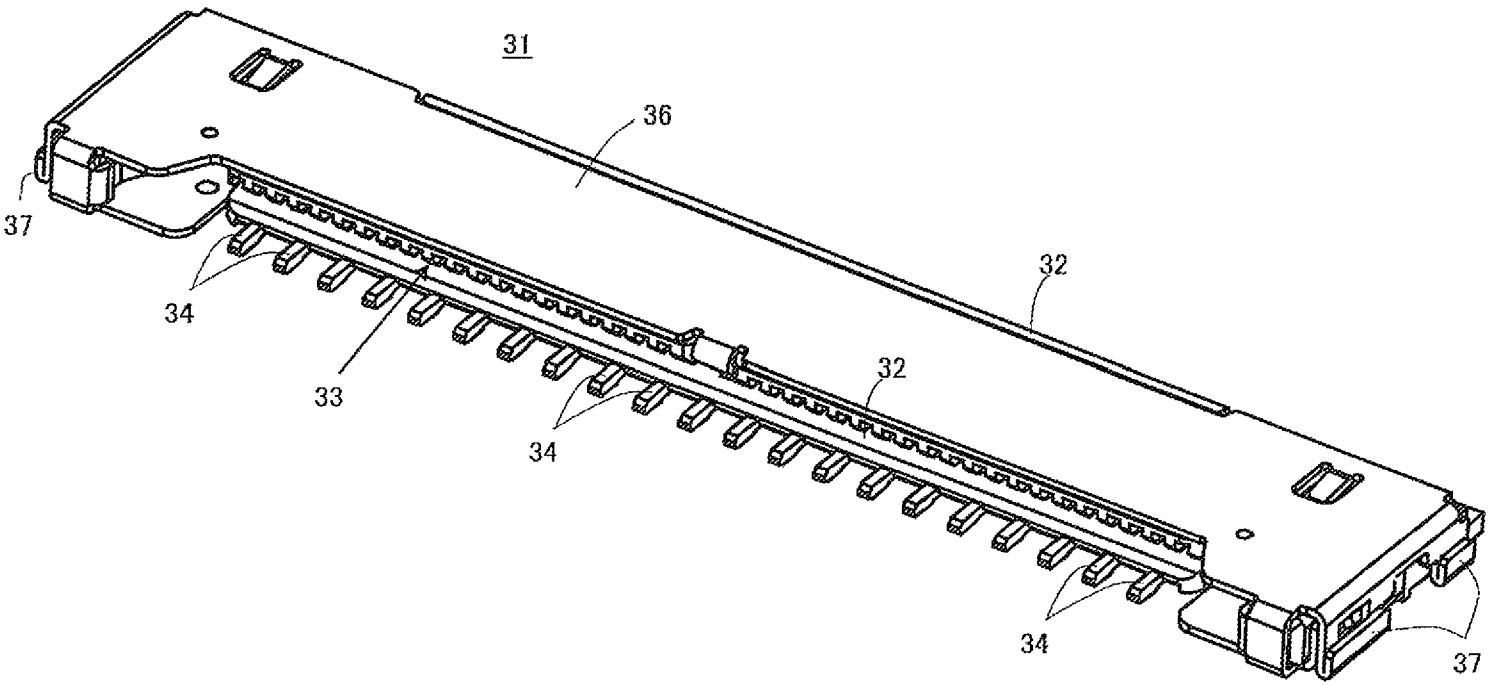
FIG. 6 is a schematic front perspective view showing a receptacle type connector constituting the embodiment of cable connecting apparatus according to the present invention.
Figure 7:
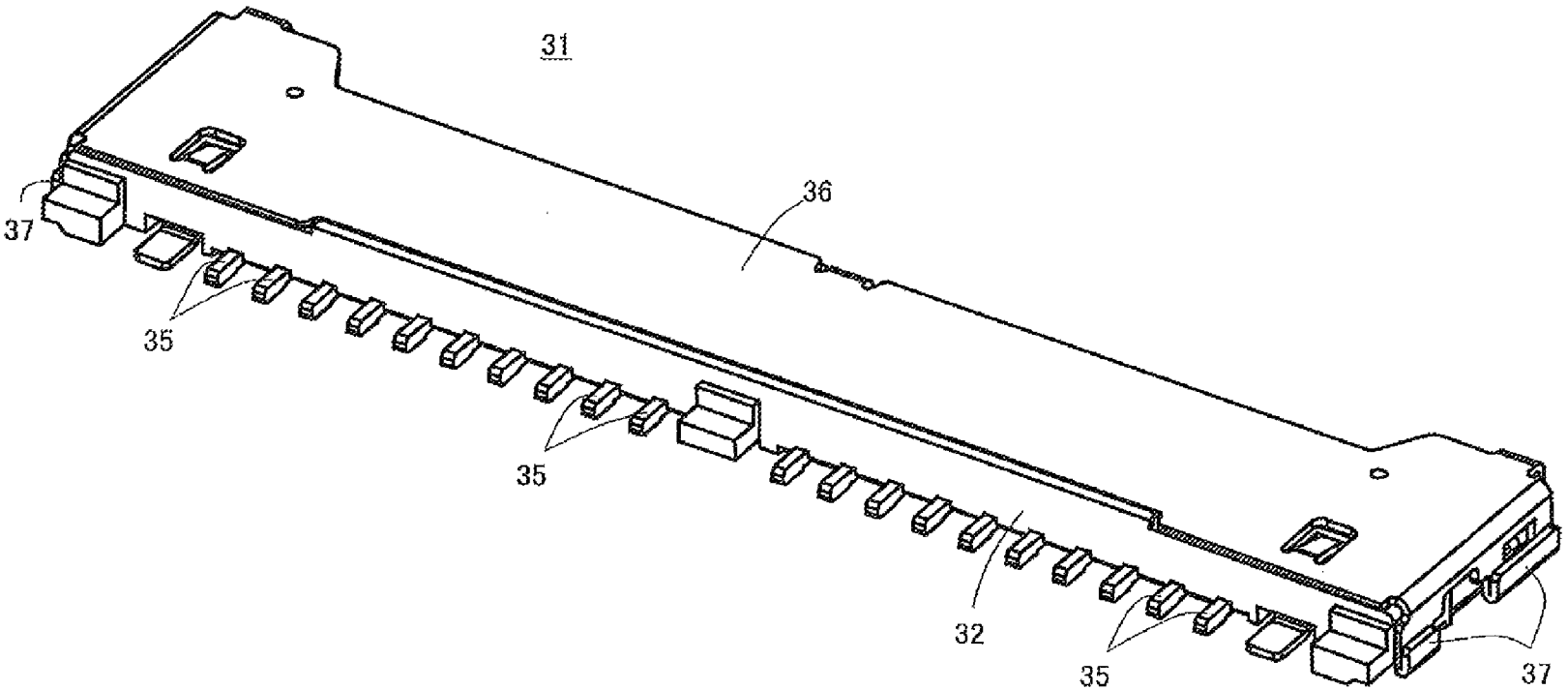
FIG. 7 is a schematic rear perspective view showing the receptacle type connector constituting the embodiment of cable connecting apparatus according to the present invention.

As shown in FIG. 10 representing a cross section taken along line X-X on FIG. 8, each of the contacts 34 included in the receptacle contacts has a pair of an upper beam 41 and a lower beam 42 constituting a fork-shaped portion. The upper beam 41 and the lower beam 42 are provided to constitute respectively first and second contacting portions operative to be opposite to each other. The upper beam 41 constituting the first connecting portion has a contacting point 43 provided at a top end portion thereof. The lower beam 42 constituting the second connecting portion has a contacting point 44 provided at a central portion thereof and a connecting terminal 45 and an engaging projection 46 for engaging with the housing 32 provided respectively at both end portions thereof opposite to each other with the contacting point 44 between.

Under such a situation, a distance L1 from the front end portion 32*a* (in FIG. 10) of the housing 32 at which the opening 33 is formed to the contacting point 43 is set to be shorter than a distance L2 from the front end portion 32*a* of the housing 32 at which the opening 33 is formed to the contacting point 44. That is, the contacting point 44 provided at the central portion of the lower beam 42 is more distant from the front end portion 32*a* of the housing 32 at which the opening 33 is formed than the contacting point 43 provided at the top end portion of the upper beam 41.

Each of the contacts 34 is formed by means of processing a resilient conductive plate to be punched. Allowable resilient deformation of the upper beam 41 is set to be larger than that of the lower beam 42 and therefore a resilient shift of the contacting point 43 is larger than that of the contacting point 44. The connecting terminal 45 provided at the end portion of the lower beam 42 is connected electrically by means of, for example, soldering with a corresponding one of the circuit terminals provided on the electric circuit board when the receptacle type connector 31 is fixed in its entirety to the electric circuit board.

Figure 11:
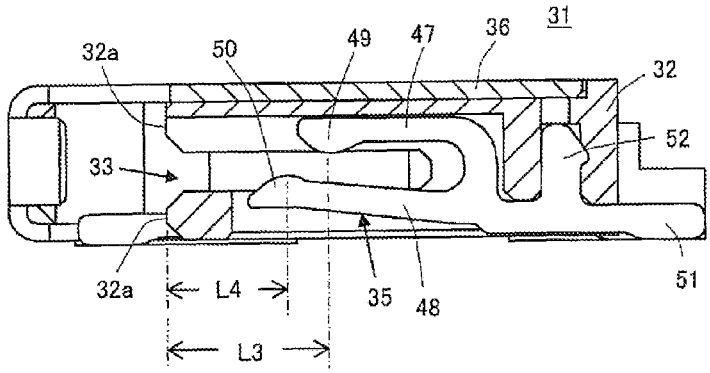
FIG. 11 is a schematic cross sectional view taken along line XI-XI on FIG. 8.

Further, as shown in FIG. 11 representing a cross section taken along line XI-XI on FIG. 8, each of the contacts 35 included in the receptacle contacts has a pair of an upper beam 47 and a lower beam 48 constituting a fork-shaped portion in the similar manner as each of the first contacts 34. The upper beam 47 and the lower beam 48 are provided to constitute respectively third and fourth contacting portions operative to be opposite to each other. The upper beam 47 constituting the third connecting portion has a contacting point 49 provided at a top end portion thereof. The lower beam 48 constituting the fourth connecting portion has a contacting point 50 and a connecting terminal 51 provided respectively at both end portions thereof and an engaging projection 52 engaging with the housing 32 provided at a portion thereof between the contacting point 50 and the connecting terminal 51.

Under such a situation, a distance L3 from the front end portion 32*a* (in FIG. 11) of the housing 32 at which the opening 33 is formed to the contacting point 49 is set to be longer than a distance L4 from the front end portion 32*a* of the housing 32 at which the opening 33 is formed to the contacting point 50. That is, the contacting point 49 provided at the top end portion of the upper beam 47 is more distant from the front end portion 32*a* of the housing 32 at which the opening 33 is formed than the contacting point 50 provided at one of the end portions of the lower beam 48.

Each of the contacts 35 is also formed by means of processing a resilient conductive plate to be punched. Allowable resilient deformation of the lower beam 48 is set to be larger than that of the upper beam 47 and therefore a resilient shift of the contacting point 50 is larger than that of the contacting point 49. The connecting terminal 51 provided at the other of the end portions of the lower beam 48 is connected electrically by means of, for example, soldering with a corresponding one of the circuit terminals provided on the electric circuit board when the receptacle type connector 31 is fixed in its entirety to the electric circuit board.

Figure 12:
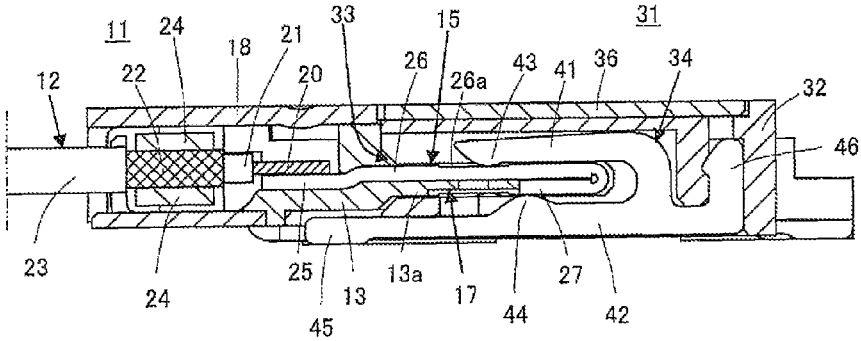
FIG. 12 is a schematic cross sectional view showing the plug type and receptacle type connectors constituting the embodiment of cable connecting apparatus according to the present invention, which are coupled with each other, together with the coaxial cable coupled with the plug type connector.
Figure 13:
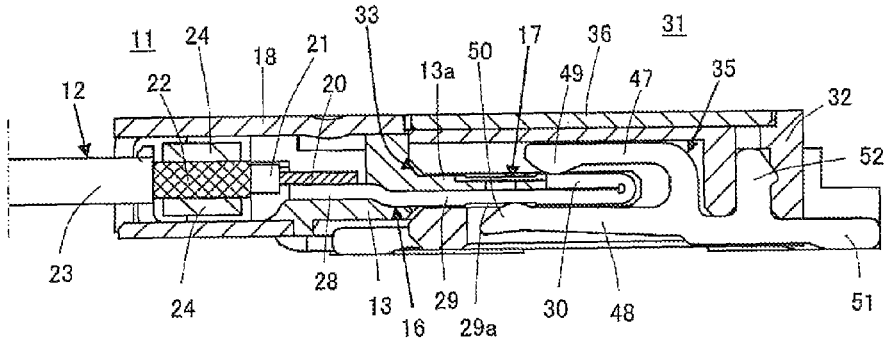
FIG. 13 is a schematic cross sectional view showing the plug type and receptacle type connectors constituting the embodiment of cable connecting apparatus according to the present invention, which are coupled with each other, together with the coaxial cable coupled with the plug type connector.

FIGS. 12 and 13 shows the embodiment of cable connector according to the present invention put in a condition wherein the connectively engaging portion 17 of the plug type connector 11 is inserted in the housing 32 of the receptacle type connector 31 through the opening 33 provided thereon so that the plug type connector 11 and the receptacle type connector 31 are coupled with each other.

Under the condition wherein the connectively engaging portion 17 of the plug type connector 11 is inserted in the housing 32 of the receptacle type connector 31 through the opening 33 provided thereon, the connectively engaging portion 17 of the plug type connector 11 is positioned between the upper beam 41 and the lower beam 42 constituting the fork-shaped portion of each of the contacts 34 of the receptacle type connector 31, as shown in FIG. 12

The contacting point 43 provided at the top end portion of the upper beam 41 of each of the contacts 34 is put in press-contact with the recess 26*a* provided on the contact-receiving portion 26 of a corresponding one of the contacts 15 on the side of the upper surface of the connectively engaging portion 17 of the plug type connector 11 and the contacting point 44 provided at the central portion of the lower beam 42 of the said contact 34 is put in press-contact with the contact-receiving portion 27 of the said contact 15 on the side of the lower surface of the connectively engaging portion 17 of the plug type connector 11. On that occasion, a position on each of the contacts 15 at which the contacting point 43 is put in press-contact with the recess 26*a* provided on the contact-receiving portion 26 on the side of the upper surface of the connectively engaging portion 17 is apart from a position on the said contact 15 at which the contacting point 44 is put in press-contact with the contact-receiving portion 27 on the side of the lower surface of the connectively engaging portion 17 in a direction along which the contacts 15 elongates.

This results in that a portion of the contact 15 to which the contacting point 43 exerts pressure on the side of the upper surface of the connectively engaging portion 17 is apart from a portion of the contact 15 to which the contacting point 44 exerts pressure on the side of the lower surface of the connectively engaging portion 17 and therefore it can be avoided that the pressure by the contacts 34 each put in press-contact with the contact 15 concentrates to a particular portion of the contact 15.

Further, under the condition wherein the connectively engaging portion 17 of the plug type connector 11 is inserted in the housing 32 of the receptacle type connector 31 through the opening 33 provided thereon, the connectively engaging portion 17 of the plug type connector 11 is positioned also between the upper beam 47 and the lower beam 48 constituting the fork-shaped portion of each of the contacts 35 of the receptacle type connector 31, as shown in FIG. 13

The contacting point 50 provided at the end portion of the lower beam 48 of each of the contacts 35 is put in press-contact with the recess 29*a* provided on the contact-receiving portion 29 of a corresponding one of the contacts 16 on the side of the lower surface of the connectively engaging portion 17 of the plug type connector 11 and the contacting point 49 provided at the top end portion of the upper beam 47 of the said contact 35 is put in press-contact with the contact-receiving portion 30 of the said contact 16 on the side of the upper surface of the connectively engaging portion 17 of the plug type connector 11. On that occasion, a position on each of the contacts 16 at which the contacting point 50 is put in press-contact with the recess 29*a* provided on the contact-receiving portion 29 on the side of the lower surface of the connectively engaging portion 17 is apart from a position on the said contact 16 at which the contacting point 49 is put in press-contact with the contact-receiving portion 30 on the side of the upper surface of the connectively engaging portion 17 in a direction along which the contacts 16 elongates.

This results in that a portion of the contact 16 to which the contacting point 50 exerts pressure on the side of the lower surface of the connectively engaging portion 17 is apart from a portion of the contact 16 to which the contacting point 49 exerts pressure on the side of the upper surface of the connectively engaging portion 17 and therefore it can be avoided that the pressure by the contacts 35 each put in press-contact with the contact 16 concentrates to a particular portion of the contact 16.

Besides, since, in each of the contacts 34, the resilient shift of the contacting point 43 operative to exert the pressure to the connectively engaging portion 17 on the side of the upper surface thereof is larger than that of the contacting point 44 operative to exert the pressure to the connectively engaging portion 17 on the side of the lower surface thereof, and in each of the contacts 35, the resilient shift of the contacting point 50 operative to exert the pressure to the connectively engaging portion 17 on the side of the lower surface thereof is larger than that of the contacting point 49 operative to exert the pressure to the connectively engaging portion 17 on the side of the upper surface thereof, the pressure exerted by the contacts 34 and the contacts 35 to the connectively engaging portion 17 on the side of the upper surface thereof and the pressure exerted by the contacts 34 and the contacts 35 to the connectively engaging portion 17 on the side of the lower surface thereof are well-balanced.

As described above, in the embodiment of cable connector according to the present invention which comprises the plug type connector 11 and the receptacle type connector 31, it can be avoided that the pressure by the contact 34 put in press-contact with the contact 15 concentrates to the particular portion of the contact 15 and the pressure by the contact 35 each put in press-contact with the contact 16 concentrates to the particular portion of the contact 16 when the contacts 34 come into press-contact respectively with the contacts 15 and the contacts 35 come into press-contact respectively with the contacts 16. Therefore, the contacts 34 and the contacts 35 can be surely connected respectively with the contacts 15 and the contacts 16 provided on the connectively engaging portion 17 of the plug type connector 11 even if the connectively engaging portion 17 is improved to reduce its thickness and the connectively engaging portion 17 of the plug type connector 11 can be held stably without becoming unstable in its posture and bringing about undesirable changes in its posture and position when the contacts 34 and the contacts 35 are put in press-contact respectively with the contacts 15 and the contacts 16 provided on the connectively engaging portion 17 of the plug type connector 11.

Especially, since the contacts 15 and the contacts 16 are arranged one after the other on the connectively engaging portion 17 of the plug type connector 11 and, in correspondence therewith, the contacts 34 and the contacts 35 are arranged also one after the other in the housing 32 of the receptacle type connector 31, a condition wherein the contacts 34 and the contacts 35 are surely connected respectively with the contacts 15 and the contacts 16 provided on the connectively engaging portion 17 of the plug type connector 11 and the connectively engaging portion 17 of the plug type connector 11 is held stably without becoming unstable in its posture and bringing about undesirable changes in its posture and position when the contacts 34 and the contacts 35 are put in press-contact respectively with the contacts 15 and the contacts 16, can be obtained still more effectively, Further, since the plug contacts provided on the connectively engaging portion 17 of the plug type connector 11 include the contacts 15 and the contacts 16 arranged one after the other, each of the contacts 15 has the contact-receiving portion 26 with which the contacting point 43 of the contact 34 of the receptacle type connector 31 comes into press-contact and the contact-receiving portion 27 folded back from the contact-receiving portion 26, with which the contacting point 44 of the contact 34 comes into press-contact, each of the contacts 16 has the contact-receiving portion 29 with which the contacting point 50 of the contact 35 of the receptacle type connector 31 comes into press-contact and the contacting point 49 folded back from the contacting point 50, with which the contacting point 49 of the contact 35 comes into press-contact, and the top end portion of the contact-receiving portion 26 of each of the contacts 15 and the top end portion of the contact-receiving portion 29 of each of the contacts 16 are provided to be partially surrounded by the insulating material forming the connectively engaging portion 17 of the plug type connector 11, the connectively engaging portion 17 of the plug type connector 11 can be reduced effectively in its thickness and provided with the contacts 34 and the contacts 35 each stuck firmly on the insulating material forming the connectively engaging portion 17 of the plug type connector 11.

In addition, since the contacting point 43 provided at the top end portion of the upper beam 41 of each of the contacts 34 comes into press-contact with the recess 26*a* provided on the contact-receiving portion 26 of the corresponding one of the contacts 15 and the contacting point 50 provided at the end portion of the lower beam 48 of each of the contacts 35 comes into press-contact with the recess 29*a* provided on the contact-receiving portion 29 of the corresponding one of the contacts 16 when the contacts 34 come into press-contact respectively with the contacts 15 and the contacts 35 come into press-contact respectively with the contacts 16, the contacting point 43 and the recess 26*a* engaging with each other produce a click and the contacting point 50 and the recess 29*a* engaging with each other produce also a click when the connectively engaging portion 17 of the plug type connector 11 is inserted in the housing 32 of the receptacle type connector 31 through the opening 33 provided thereon, and the contacting point 43 meets with resistance caused by the recess 26*a* and the contacting point 50 meets also with resistance caused by the recess 29*a* when the connectively engaging portion 17 of the plug type connector 11 is drawn out of the housing 32 of the receptacle type connector 31 through the opening 33 provided thereon.

What is claimed is:

1. A cable connecting apparatus comprising:

a plug type connector having a connectively engaging portion on which a plurality of plug contacts are arranged to be connected with a plurality of cables, and a receptacle type connector having a housing on which an opening through which the connectively engaging portion of the plug type connector is inserted in the housing is provided to be formed at an end portion of the housing and a plurality of receptacle contacts arranged in the housing for coming into press-contact with the plug contacts arranged on the connectively engaging portion of the plug type connector inserted in the housing through the opening provided thereon, wherein the receptacle contacts include a plurality of first contacts and a plurality of second contacts, wherein each of the first contacts has first and second contacting portions operative to be opposite to each other with the connectively engaging portion of the plug type connector inserted in the housing through the opening provided thereon between, said first and second contacting portions having respectively first and second contacting points, a distance from the end portion of the housing at which the opening is formed to said first contacting point being shorter than a distance from the end portion of the housing at which the opening is formed to said second contacting point, said first contacting point being operative to come into press-contact with the plug contact on the side of a first surface of the connectively engaging portion of the plug type connector, and said second contacting point being operative to come into press-contact with the plug contact on the side of a second surface opposite to the first surface of the connectively engaging portion of the plug type connector, and wherein each of the second contacts has third and fourth contacting portions operative to be opposite to each other with the connectively engaging portion of the plug type connector inserted in the housing through the opening provided thereon between, said third and fourth contacting portions having respectively third and fourth contacting points, a distance from the end portion of the housing at which the opening is formed to said third contacting point is longer than a distance from the end portion of the housing at which the opening is formed to said fourth contacting point, said third contacting point being operative to come into press-contact with the plug contact on the side of the first surface of the connectively engaging portion of the plug type connector, and said fourth contacting point being operative to come into press-contact with the plug contact on the side of the second surface opposite to the first surface of the connectively engaging portion of the plug type connector.

2. A cable connecting apparatus according to claim 1, wherein the first and second contacting portions are formed in the shape of a pair of beams constituting a fork-shaped portion of the first contact, one of which is provided thereon the first contacting point and the other of which is provided with the second contacting point and a connecting terminal, and the third and fourth contacting portions are formed in the shape of a pair of beams constituting a fork-shaped portion of the second contact, one of which is provided thereon the third contacting point and the other of which is provided with the fourth contacting point and a connecting terminal.

3. A cable connecting apparatus according to claim 1, wherein the first contacts and the second contacts are arranged one after the other in a direction along which the receptacle contacts are arranged.

4. A cable connecting apparatus according to claim 1, wherein the plug contacts include a plurality of third contacts and a plurality of fourth contacts, which are arranged one after the other in a direction along which the plug contacts are arranged, each of said third contacts having a cable connecting portion with which the cable is connected, a first contact-receiving portion with which one of the first and second contacting points of the first contact comes into press-contact and a second contact-receiving portion folded back from the first contact-receiving portion, with which the other of the first and second contacting points of the first contact comes into press-contact, each of said fourth contacts having a cable connecting portion with which the cable is connected, a third contact-receiving portion with which one of the third and fourth contacting points of the second contact comes into press-contact and a fourth contact-receiving portion folded back from the third contact-receiving portion, with which the other of the third and fourth contacting points of the second contact comes into press-contact, and a top end portion of the second contact-receiving portion of each of said third contacts and a top end portion of the fourth contact-receiving portion of each of said fourth contacts being provided to be partially surrounded by insulating material forming the connectively engaging portion of the plug type connector.

5. A cable connecting apparatus according to claim 4, wherein the second contact-receiving portion folded back from the first contact-receiving portion of the third contact and the fourth contact-receiving portion folded back from the third contact-receiving portion of the fourth contact are provided respectively on the first and second surfaces opposite to each other of the connectively engaging portion of the plug type connector.

6. A cable connecting apparatus according to claim 4, wherein the first contact-receiving portion of the third contact is provided thereon with a recess with which one of the first and second contacting points of the first contact comes into press-contact and the third contact-receiving portion of the fourth contact is provided thereon with a recess with which one of the third and fourth contacting points of the second contact comes into press-contact.

* * * * *